US008534238B2

(12) United States Patent
Powers et al.

(10) Patent No.: US 8,534,238 B2
(45) Date of Patent: Sep. 17, 2013

(54) SMART FAN CLUTCH

(75) Inventors: Jason Powers, Brighton, MI (US); Thomas Deuter, Brighton, MI (US)

(73) Assignee: Behr America, Inc., Troy, MI (US)

( * ) Notice: Subject to any disclaimer, the term of this patent is extended or adjusted under 35 U.S.C. 154(b) by 1045 days.

(21) Appl. No.: 12/055,707

(22) Filed: Mar. 26, 2008

(65) Prior Publication Data

US 2008/0236981 A1 Oct. 2, 2008

Related U.S. Application Data

(60) Provisional application No. 60/920,819, filed on Mar. 30, 2007.

(51) Int. Cl.
*F01P 9/00* (2006.01)

(52) U.S. Cl.
USPC ..... 123/41.01

(58) Field of Classification Search
USPC .... 123/41.11, 41.15, 41.56, 41.01; 192/84.1, 192/31, 82 T, 40; 415/1; 165/244
See application file for complete search history.

(56) References Cited

U.S. PATENT DOCUMENTS

| | | | | |
|---|---|---|---|---|
| 4,358,936 | A * | 11/1982 | Ito et al. | 62/229 |
| 4,650,045 | A | 3/1987 | Weible et al. | |
| 5,094,332 | A * | 3/1992 | Wall | 192/82 T |
| 5,161,659 | A * | 11/1992 | Elmer | 192/58.62 |
| 5,445,128 | A * | 8/1995 | Letang et al. | 123/436 |
| 5,529,028 | A * | 6/1996 | Weikert | 123/41.12 |
| 5,623,835 | A | 4/1997 | Layman et al. | |
| 5,947,248 | A * | 9/1999 | Link | 192/84.1 |
| 6,253,716 | B1 * | 7/2001 | Palmer et al. | 123/41.12 |
| 6,894,883 | B2 * | 5/2005 | Buchholz | 361/103 |
| 7,178,656 | B2 * | 2/2007 | Pickelman et al. | 192/103 F |
| 7,255,065 | B2 * | 8/2007 | McLachlan | 123/18 R |
| 7,415,945 | B2 * | 8/2008 | Tuttle | 123/41.11 |
| 7,503,444 | B2 * | 3/2009 | Bohan | 192/58.61 |
| 2004/0011306 | A1 | 1/2004 | Liederman et al. | |
| 2004/0103861 | A1 | 6/2004 | Odeskog et al. | |
| 2005/0103302 | A1 * | 5/2005 | You | 123/179.4 |
| 2006/0237277 | A1 * | 10/2006 | Bohan | 192/58.61 |
| 2006/0254540 | A1 * | 11/2006 | Tuttle | 123/41.49 |

FOREIGN PATENT DOCUMENTS

| | | |
|---|---|---|
| EP | 0 889 211 B1 | 1/1999 |
| EP | 1 284 344 A2 | 2/2003 |
| EP | 1 710 412 B1 | 10/2006 |

* cited by examiner

*Primary Examiner* — Noah Kamen
*Assistant Examiner* — Hung Q Nguyen
(74) *Attorney, Agent, or Firm* — Foley & Lardner LLP

(57) ABSTRACT

Systems, methods and devices for the control of fans are presented. More specifically, the invention relates to a fan clutch control unit for a vehicle fan. The fan clutch control unit executes a control loop section and a strategy section to provide control functionality. The fan clutch control unit may be provided as a pre-packaged control board or integrated into a fan clutch.

14 Claims, 6 Drawing Sheets

SMART FAN CLUTCH

CROSS REFERENCE TO RELATED APPLICATIONS

The present application claims benefit of priority to U.S. Provisional Application Ser. No. 60/920,819, filed Mar. 30, 2007, the entire contents of which is incorporated herein by reference.

FIELD OF THE INVENTION

The embodiments of the present invention relate generally to systems, methods and devices for controlling fans, including engine fans. More specifically, certain embodiments of the present invention relate to systems, methods and devices for controlling modulating fan clutches for engines via the use of discrete control units having embedded software and in communication with an engine or the control unit of an engine. Certain embodiments will be useful in heavy vehicle applications.

BACKGROUND OF THE INVENTION

In conjunction with increasingly demanding vehicle emission standards, the need for more precise control of machine cooling systems is being felt. In particular, vehicle emission standards are expected to become stricter, causing a need for increased control over vehicle engine fans. This is a particular need in the heavy truck market.

Vehicle manufacturers and OEMs have, however, had a difficult time integrating precise control over vehicle engine fans. This has resulted in the widespread use of simple binary (on-off) type fan systems that lack efficiency but are possible to implement. There is thus a need for a more precise technology for controlling machine cooling systems, and in particular vehicle engine fans.

SUMMARY OF THE INVENTION

Embodiments of the invention relate to a fan system, comprising: an engine control unit; a fan clutch control unit; a modulating fan clutch; and a fan; wherein the fan clutch control unit is connected to the fan clutch by one or more conducting wires and acts to control the fan clutch based on input data. The fan clutch control unit can be a pre-packaged control board or embedded in the modulating fan clutch. The fan system can comprise an MCU and a memory having embedded therein software comprising a control section and a strategy section. Optionally, the control section comprises a PID control loop and the fan clutch control unit comprises at least one of the following I/O interfaces: CAN, $I^2C$, SPI, CSI, QSPI, UART, USART, USB. More preferably, the fan clutch control unit comprises a CAN interface in communication with an Engine Control Unit. Optionally, the MCU provides diagnostic data to the Engine Control Unit and does not perform an engine control function other than control of the fan clutch.

Further embodiments of the invention relate to a control unit, comprising: a pre-packaged board comprising an MCU; the MCU further comprising a CAN interface; wherein the control unit comprises software embedded in a memory in the control unit or MCU, and wherein the software when executed would perform a method comprising: accepting input data over the CAN interface; using at least a portion of the input data in a control loop calculation; and outputting control data to an output interface connectable to a fan clutch.

The method may further comprise using the input data in a control loop calculation; executing a PID control loop; using at least a second portion of the input data to predict a future state; and generating further input data for the control loop calculation based on the future state. The method may also comprise receiving fan clutch data from the interface connectable to a fan clutch, performing a diagnostic check on the fan clutch data, and broadcasting diagnostic information over the CAN interface.

Additional embodiments of the invention relate to a vehicle, comprising: a passenger compartment; an engine, an Engine Control Unit in communication with the engine; a fan; a modulating fan clutch; and a modulating fan clutch control unit in communication with the Engine Control Unit and the fan. Optionally, the modulating fan clutch control unit is a pre-packaged control board or is embedded in the modulating fan clutch.

Still further embodiments of the invention relate to a method for providing control of a fan clutch, comprising: providing a fan and a fan clutch to an engine; connecting the fan via the fan clutch to a control unit; the control unit comprising at least an MCU; connecting the MCU via at least one I/O interface to an Engine Control Unit, such that when operated, data will be passed between the MCU and the Engine Control Unit over the I/O interface; and wherein the Engine Control Unit is usable to control portions of the engine; and providing control software to the MCU or a connected memory device for controlling the fan clutch based at least on data passed from the Engine Control Unit to the MCU. The method may also be performed where the MCU is specifically part of a pre-packaged control board or where the MCU is integrated into or onto the fan clutch.

DETAILED DESCRIPTION OF THE PREFERRED EMBODIMENTS

Figure 1:
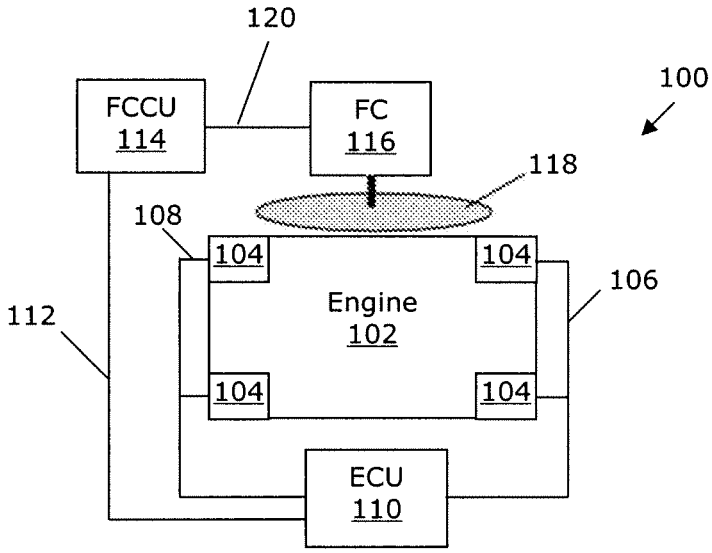
FIG. 1 is a block diagram showing a vehicle system employing a control unit for a fan clutch.

Referring to FIG. 1, there is shown a block diagram showing a vehicle system 100. While the system 100 is shown as a vehicle system, it will be appreciated that the principles described herein can be applied to other systems that require cooling. The system 100 has an engine 102 having a plurality of sensors 104. The sensors are attached, for example, to communications buses 106 and 108, which allow them to be in communication with engine control unit 110.

Engine control unit 110 is further in communication with fan clutch control unit 114 over bus 112, which is in a preferred embodiment a Controller Area Network (CAN) bus conforming to revision 2.0A and 2.0B of the CAN standard. The CAN bus transmits differential signals and has a built in cyclic redundancy check, thereby allowing for accurate data transmission in an electromagnetically noisy environment. Any number of different interfaces could be used depending on conditions, however, for example $I^2C$, SPI (Serial Peripheral Interface), CSI (Clocked Serial Interface), Microwire, UART (Universal Asynchronous Receive and Transmit), USART (Universal Synchronous/Asynchronous Receive and Transmit) and USB (Universal Serial Bus). Fan clutch control unit 114 controls fan clutch 116, which controls the speed of fan 118.

Engine 102 can be a standard engine of known type. Sensors 104 are positioned at various points within the engine 102, and are used to measure the state of variables within the engine 102. For example, one of the sensors 104 might measure the engine speed, coolant temperature, air conditioning system pressures, engine oil temperature, transmission oil temperature, etc. The sensors 104 provide their readings to engine control unit 110 over communication buses 106 and 108.

A control unit as used in this specification is an electronic component that helps to guide the performance of another electrical or mechanical component. Correspondingly, an engine control unit is an electronic component that helps to guide the performance of an engine. Engine control unit 110 comprises a microcomputing unit (MCU) (not shown) such as a microcontroller or microprocessor. Data provided by sensors 104 are used by the MCU to evaluate the state of the vehicle, to predict future states and to provide control signals to make adjustments where necessary. The engine control unit 110 thus provides an overall control function for the vehicle system 100.

The temperature of engine 102 is in part regulated by fan 118, which is responsible for inducing the flow of outside air onto engine 102. Fan 118 is controlled by a fan clutch 116, which provides current over a coil to the fan clutch which in turn engages the fan. The fan clutch 116 is preferably a modulating fluid shear fan clutch, having a silicone fluid viscosity of approximately 4000 Cts. A modulating fan clutch is simply a fan clutch that can operate a fan at a range of speeds or a number of different discrete speeds, as opposed to a binary fan clutch, which can only operate the fan at a single speed or disengage the fan. The fan 118, which is preferably a BEHR® Ring Fan with Nylon 6/6 Plastic ML500/9 blades, can be varied in speed depending on the temperature conditions within the engine 102, as determined, for example, by the sensors 104. Control of the fan clutch is provided by the fan clutch control unit 114, which is shown here as a separate unit and provided in this embodiment as a separate board.

Fan clutch control unit 114 is in the embodiment of FIG. 1 a pre-packaged control board, which means that the board is assembled and packaged prior to integration into the vehicle system 100. The pre-packaged control board of fan clutch control unit 114 has embedded control software for controlling fan clutch 116 and is advantageous in that it allows the control programming to be separated from the engine control unit, thereby avoiding integration of the control routine into the overall engine control application of ECU 110. This saves integration resources and efficiently partitions the integration work between fan system and vehicle system engineers. It also saves computing resources on the ECU 110 and reduces the wiring complexity of the system overall.

Fan clutch control unit 114 receives signals over communications bus 112 from the engine control unit 110. These signals can include a variety of data points, including the current temperature, the vehicle speed, the oil pressure, etc. Fan clutch control unit 114 calculates the current system state and makes adjustments to various control signals to properly control fan clutch 116.

Figure 2:
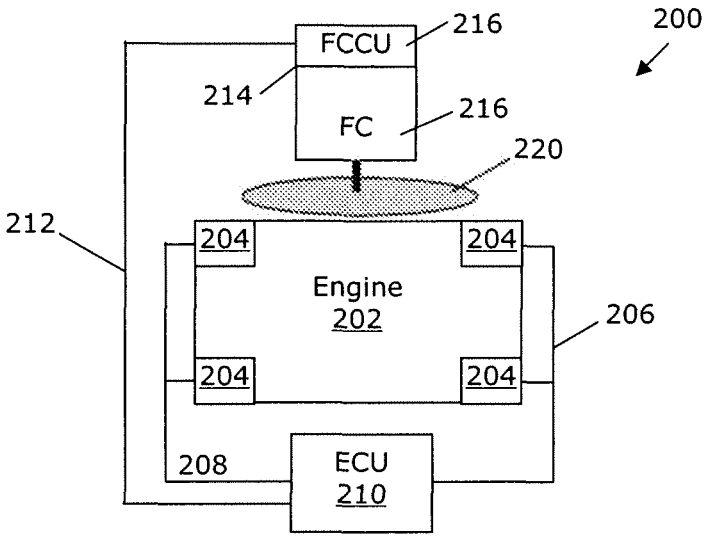
FIG. 2 is a block diagram showing a vehicle system employing a control unit for a fan clutch.

Referring now to FIG. 2, there is shown an alternate system embodiment. FIG. 2 shows a vehicle system 200, having an engine 202 with corresponding sensors 204. The sensors are connected over buses 206 and 208 to engine control unit 210, which is similar to engine control unit 110 in FIG. 1. Engine control unit 210 communicates over bus 212 with integrated unit 214. Integrated unit 214 comprises both a fan clutch control unit 216 and a fan clutch mounted in or on the same housing. The integrated unit 214 communicates with engine control unit 210 to receive information about the engine 202 and the state of the vehicle system 200, in order to control fan 220 with the objective of optimal cooling.

Figure 3:
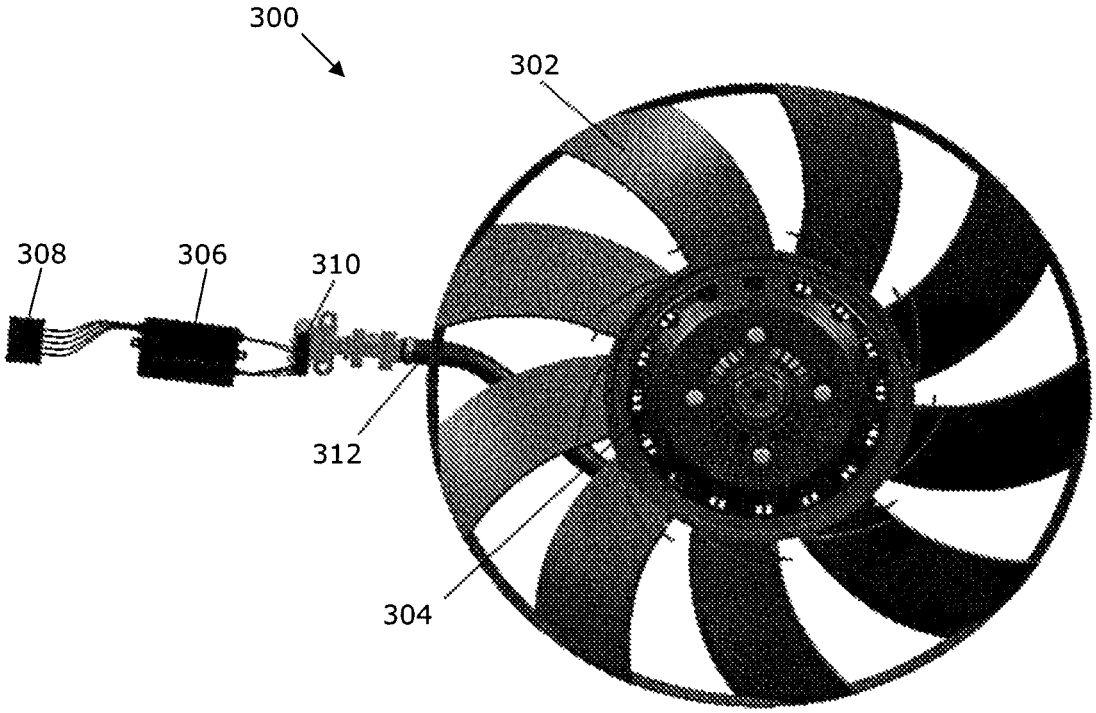
FIG. 3 depicts an engine fan as seen from the engine of a vehicle.

FIG. 3 shows a fan system 300 corresponding to an embodiment shown in FIG. 1. System 300 has a fan unit 302, which has a four-bolt hub 304, behind which is a fan clutch (not shown). The fan 302 is positioned such as it would be observed from the perspective of a person in the position of the engine. The hub 304 is connected via the fan clutch (not shown) to the cable 312, which is in turn connected via connector 310 to a pre-packaged control board 306, which houses a fan clutch control unit. Pre-packaged control board 306 is in turn connected to a bus by connector 308. The configuration shown in FIG. 3 allows easy installation of a sophisticated fan clutch control system in the form of pre-packaged control board 306 without the necessity for extensive reprogramming of an engine control unit.

Figure 4:
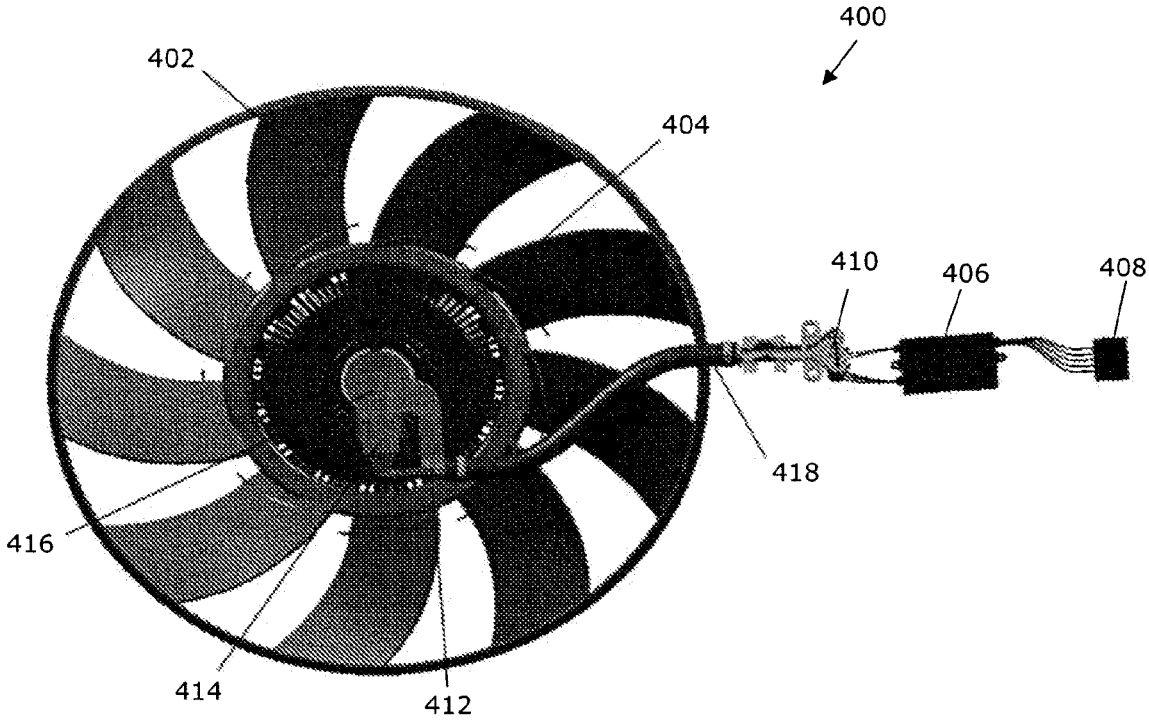
FIG. 4 depicts an engine fan as seen from the radiator of a vehicle.

FIG. 4 depicts a similar fan system 400, this time shown from the perspective of a person looking through the fan toward the engine. System 400 has a fan 402 with a hub 404. Connected to the hub is fan clutch 416, which is connected to cable 418 via connector 414. Cable 418 is guided safely parallel to the fan and its insulation terminated by flange connector 412. Cable 418 is connected at the other end to pre-packaged control board 406, which houses a fan clutch control unit (not shown), via connector 410. Pre-packaged control board 406 is further connected to a bus over connector 408.

Figure 5:
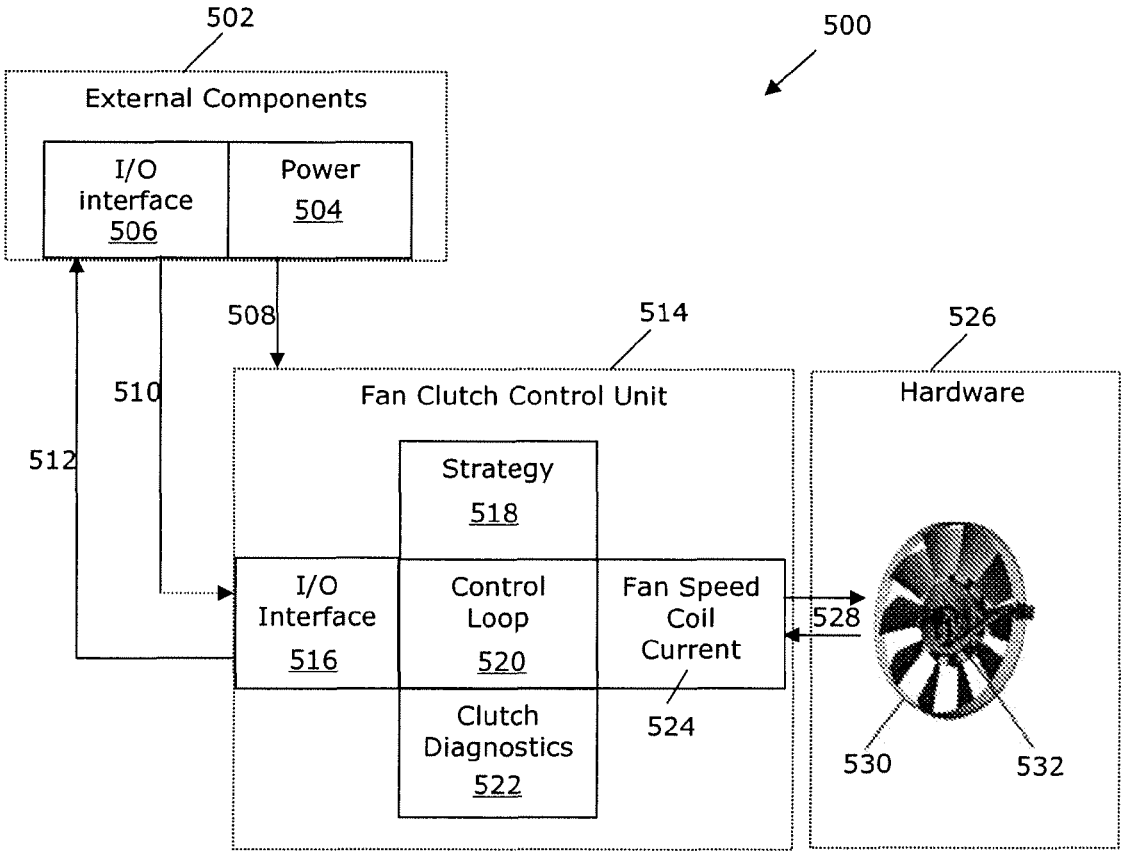
FIG. 5 is a block diagram illustrating the functions of a control unit and communication with an engine control unit.

FIG. 5 illustrates the design of a fan control system 500. The fan control system 500 has various external components 502 that interact with a fan clutch control unit 514. The external components can comprise, for example, the various parts of a vehicle system, including a battery, an engine, sensors and an engine control unit (all not shown). The external components 502 provide an I/O (input/output) interface 506, possibly one of many kinds of I/O interfaces but preferably a CAN interface. The I/O interface is in communication with a corresponding I/O interface 516 of fan clutch control unit 514 over a bus comprising, in a preferred embodiment, differential lines 510 and 512. The external components 502 also provide a power source 504, which is provided to the fan clutch control unit 514 via a power bus or line 508.

Fan clutch control unit 514 is preferably implemented as a circuit board having an MCU (not shown) for executing software for the control of a fan clutch. Fan clutch control unit 514 comprises in a preferred embodiment an I/O interface 516, which may be any of several types depending on the application, but is preferably configured to operate with the CAN protocol. I/O interface 516 can be implemented in software or hardware, and is preferably an integral part of the MCU.

Fan clutch control unit 514 further comprises an MCU with a corresponding memory (not shown). The memory may be an integral part of the MCU, or may be a separate discrete component. The memory has embedded therein (i.e. stores) software that performs a method for operating a control loop. The control loop takes input data, which may be of various types depending on the available information, including for example the engine speed, coolant temperature, air conditioning system pressures, engine oil temperature, transmission oil temperature, etc. In one preferred embodiment, the control loop receives information regarding the engine speed via the I/O interface, a fan speed from the fan clutch 532 and a target fan speed from strategy section 518, while outputting a data representing a current to the fan clutch coil.

Fan clutch control unit 514 operates software that is divided into several sections, including a control loop section 520, a strategy section 518, and a clutch diagnostics section 522. A section here refers to a portion of the fan clutch control unit software that performs a specific task. Sections are usually dividable from the overall software, and may be in the form of, for example, one or more software objects, one or more discrete subroutines, or an identifiable and contiguous section of assembly code.

The control loop section 520 is a section that makes decisions about how to change state variables to achieve a desired goal. Control loop section 520 executes a digital control loop, which mathematically may take on numerous forms but is in a preferred embodiment a proportional-integral-derivative (PID) control loop. Control loop section 520 has among its responsibilities the acceptance of input data directly or indirectly from I/O interface 516 as variables representing the state of the system to be controlled. In the present example, the system to be controlled includes a fan clutch, a fan, and an engine that has various temperature readings. The control loop section 520 also has access to state variables of the fan, for example the fan speed.

Control loop section 520 executes its PID digital control loop with the aim of minimizing the difference between one or more key state variables and a target value or target values. In a preferred embodiment, the key state variables include an engine-related temperature. The control loop section 520 adjusts the speed of modulating fan 530.

Control loop section 520 also accepts input from strategy section 518. Strategy section 518 is a section that attempts to predict future system states based on current state variables, historical state variables and/or stored data. For example strategy section 518 can have information regarding system (engine) performance stored in a compact database or data table, and use the information to guess at trends in the engine. Strategy section 520 can also be configured to extrapolate trends in system state variables based on recent values. Strategy section 518 provides input data to control loop section 520 which affects the performance of control loop section 520 so that control loop section 520 can effectively "anticipate" changes in the system that would otherwise cause poorer tracking on its target system state. In a preferred embodiment, the strategy section 518 receives most of the input data from outside the control unit 514, whereas the control loop section 520 receives the engine speed and the current fan speed, as well as a desired fan speed from the strategy section 518. In a preferred embodiment, the strategy section 518 receives most of the input over I/) interface 516, and passes a target fan speed to control loop section 520.

In an alternative embodiment, strategy section is implemented in an external component, such as an engine control unit 110 as shown in FIG. 1. In that case, the input data from the strategy section is provided over the I/O interface 516 (FIG. 5), and is used in the control loop section 520.

The primary output of the control loop section 520 is data representing the fan speed coil current 524. This coil current is provided at 528 to hardware 526 which comprises the fan clutch 532 and a fan 530. The coil current provides the driving force for fan 530 and thus determines its speed. Through fan speed coil current 524, then, control loop 520 can alter the state (principally, the temperature) of the engine system.

Hardware 526 also returns information such as the actual fan speed or fan speed coil conditions at 528 to the fan clutch control unit 514. These values can be used in the control loop section 520 and by clutch diagnostics section 522. Clutch diagnostics section 522 is responsible for monitoring the fan clutch 532 and fan clutch control unit 514 for system health. Clutch diagnostics section 522 also allows components to be queried for easier maintenance. Clutch diagnostics section 522 can communicate with external components, such as an engine electronic control unit, by broadcasting over I/O interface 516.

Figure 6:
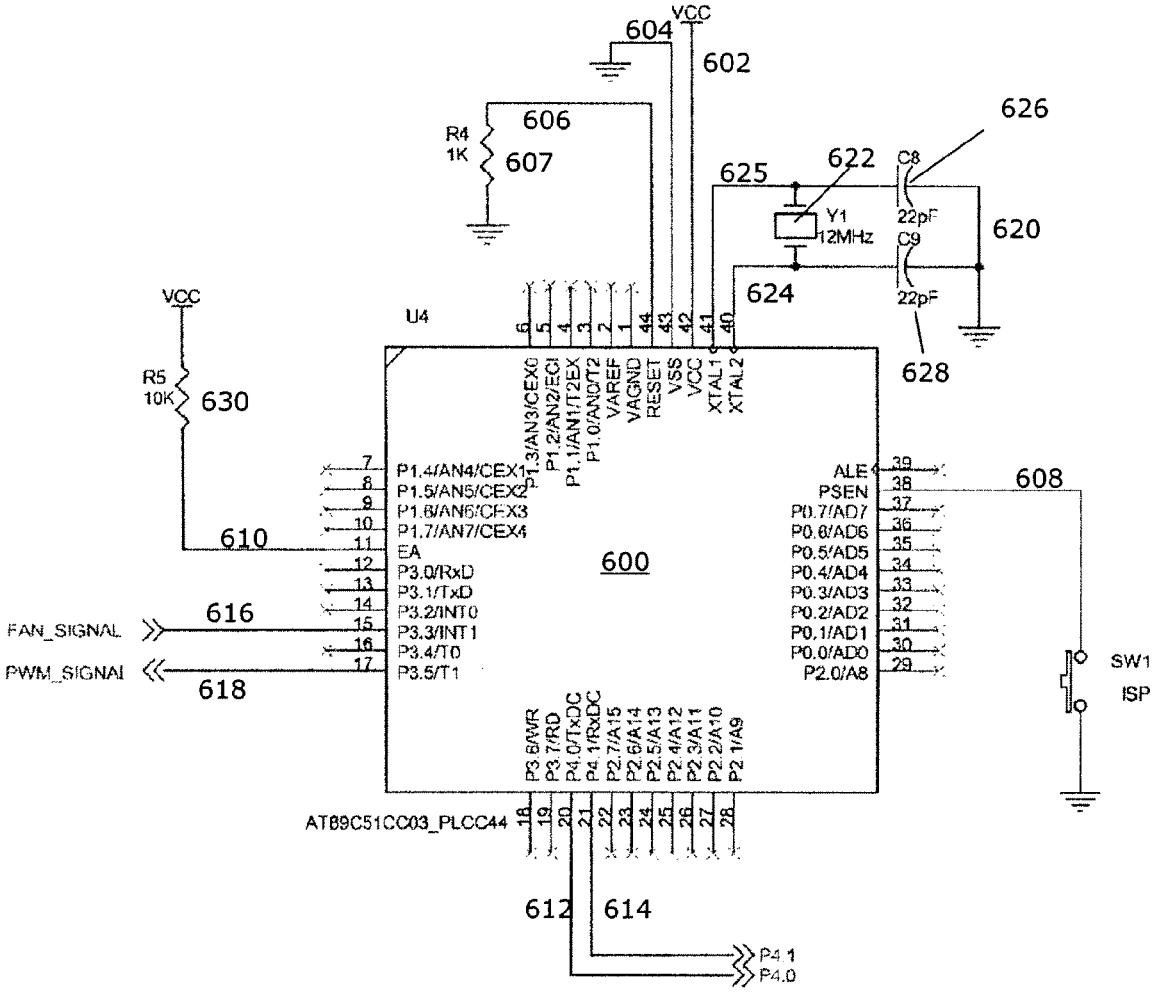
FIG. 6 is a schematic of an MCU in a control unit for a modulating fan clutch.

FIG. 6 shows an exemplary MCU 600 appropriate for use in a pre-packaged control board embodiment or integrated embodiment of a fan clutch control unit. MCU 600 is in the present example part no. AT89C51 CC03 from ATMEL® and belongs to a line of microcontrollers with integrated CAN bus capabilities. MCU 600 executes in a preferred embodiment software embodying a control loop section, a strategy section and a clutch diagnostics section, as well as software controlling the various input/output functions of the fan clutch control unit.

MCU 600 is connected via a pin to line 602 which carries a supply voltage for the MCU 600. MCU 600 is further connected via a pin to line 604 which is the circuit ground. A reset pin is connected to line 606 which contains a pull down resistor to the circuit ground or Vss. An external memory enabling signal 608 is switched directly to ground. Correspondingly, an "external access" pin is held 610 high by pull up resistor 630, reflecting that in the current embodiment program instructions should be fetched from internal Flash memory.

Data is transferred to and from the MCU 600 using several of its input/output facilities. Data input from a fan is to one of the ports of MCU 600 on line 616. Data output is performed on line 618 from a second port of MCU 600. Lines 612 and 614 represent a CAN bus, used to exchange data with external components and an integrated CAN interface driver on MCU 600.

MCU 600 is driven by a clock oscillator circuit with an external crystal resonator 622. The oscillator circuit is connected to the MCU 600 over lines 625 and 624. The oscillator circuit has a nominal oscillation frequency of around 12 Megahertz. Trimming capacitors 626 and 628 are connected at both terminals of the crystal 622 resonator and to ground.

MCU 600 so connected executes software as described principally in relation to FIG. 5, and can be used in a fan clutch control unit as described herein. The MCU may be contained in its own pre-packaged control board or integrated into or onto the fan / fan clutch assembly and sold as a fan system.

It will be apparent to those of skill in the art that the teachings of this disclosure are useful in a variety of different forms and applications, and that the intent of this disclosure is to provide exemplary embodiments, not limited by the specificity with which they are presented.

What is claimed is:

1. An fan system, comprising:

an engine control unit;

a fan;

a modulating fan clutch; and a fan clutch control unit, comprising:

a strategy section programmed to predict future system states on a basis of at least one of current state variables, historical state variables, and stored data and programmed to provide a data signal representing a predicted future system state; and a control loop section programmed to receive at least one of (1) input data representing a state of at least one of an engine, the fan, and the fan clutch, and (2) the data signal provided by the strategy section, and programmed to provide a control signal to the fan clutch to control the fan to a target speed on a basis of at least one of the input data and the data signal provided by the strategy section, wherein the fan clutch control unit is connected to the fan clutch by one or more conducting wires and is configured to control the fan clutch.

2. The fan system of claim 1, wherein the fan clutch control unit is a pre-packaged control board.

3. The fan system of claim 1, wherein the fan clutch control unit is embedded in the modulating fan clutch.

4. The fan system of claim 1, wherein the fan clutch control unit comprises an MCU and a non-volatile memory having embedded therein software comprising the control loop section and the strategy section.

5. The fan system of claim 4, wherein the control loop section comprises a PID control loop.

6. The fan system of claim 4, wherein the MCU does not perform an engine control function other than control of the fan clutch.

7. The fan system of claim 1, wherein the fan clutch control unit comprises at least one of the following I/O interfaces: CAN, $I^2C$, SPI, CSI, QSPI, UART, USART, or USB.

8. The fan system of claim 7, wherein the fan clutch control unit comprises a CAN interface in communication with the engine control unit.

9. The fan system of claim 8, wherein an MCU provides diagnostic data to the engine control unit.

10. The fan system of claim 1, wherein the fan clutch control unit further comprises a clutch diagnostics section configured to monitor the fan clutch and the fan clutch control unit by receiving an actual fan speed of the fan.

11. A vehicle, comprising:

a passenger compartment;

an engine, an engine control unit in communication with the engine;

a fan;

a modulating fan clutch; and a modulating fan clutch control unit in communication with the engine control unit and the fan, wherein the modulating fan clutch control unit comprises:

a strategy section programmed to predict future system states on a basis of at least one of current state variables, historical state variables, and stored data and programmed to provide a data signal representing a predicted future system state; and a control loop section programmed to receive at least one of (1) input data representing a state of at least one of the engine, the fan, and the fan clutch, and (2) the data signal provided by the strategy section, and programmed to provide a control signal to the fan clutch to control the fan to a target speed on a basis of at least one of the input data and the data signal provided by the strategy section.

12. The vehicle of claim 11, wherein the modulating fan clutch control unit is a pre-packaged control board.

13. The vehicle of claim 11, wherein the modulating fan clutch control unit is embedded in the modulating fan clutch.

14. The vehicle of claim 11, wherein the fan clutch control unit further comprises a clutch diagnostics section configured to monitor the fan clutch and the fan clutch control unit by receiving an actual fan speed of the fan.

* * * * *